US005528820A

United States Patent [19]

Collier

[11] Patent Number: 5,528,820

[45] Date of Patent: Jun. 25, 1996

[54] METHOD OF MAKING STRIP CONDUCTOR FOR TRANSFORMERS

[75] Inventor: Howard I. J. Collier, Kernersville, N.C.

[73] Assignee: USA Metals Corp., North Haven, Conn.

[21] Appl. No.: 351,674

[22] Filed: Dec. 8, 1994

Related U.S. Application Data

[63] Continuation of Ser. No. 883,199, May 14, 1992, abandoned.

[51] Int. Cl.[6] ..... H01F 41/06

[52] U.S. Cl. ..... 29/605; 336/205; 427/116

[58] Field of Search ..... 29/605, 609; 336/205; 427/116, 118, 120

[56] References Cited

U.S. PATENT DOCUMENTS

| | | | |
|---|---|---|---|
| 1,118,446 | 11/1914 | Roos . | |
| 2,949,593 | 8/1960 | Staley et al. . | |
| 3,246,271 | 4/1966 | Ford . | |
| 3,410,738 | 11/1968 | Gorton | 156/3 |
| 3,412,354 | 11/1968 | Sattler . | |
| 3,479,852 | 11/1969 | Conrad et al. . | |
| 3,501,728 | 3/1970 | Barriball . | |
| 3,504,104 | 3/1970 | Suzuki . | |
| 3,545,078 | 12/1970 | Lightner . | |
| 3,569,884 | 3/1971 | Wright . | |
| 3,601,837 | 8/1971 | Conrad . | |
| 3,602,022 | 8/1971 | Conrad et al. . | |
| 3,634,800 | 1/1972 | Fisher . | |
| 3,647,726 | 3/1972 | Ulmer . | |
| 3,813,294 | 5/1974 | Dyer et al. . | |
| 4,051,809 | 10/1977 | Zicker et al. . | |
| 4,084,019 | 4/1978 | Christ et al. . | |
| 4,085,159 | 4/1978 | Marsiat . | |
| 4,109,375 | 8/1978 | Lin et al. . | |
| 4,204,087 | 5/1980 | Lin et al. . | |
| 4,244,985 | 1/1981 | Graff et al. . | |
| 4,311,979 | 1/1982 | Graul . | |
| 4,368,407 | 1/1983 | Wroblewski . | |
| 4,526,804 | 7/1985 | Escallon . | |
| 4,581,293 | 4/1986 | Saunders . | |
| 5,050,293 | 9/1991 | Baldi et al . | |
| 5,176,755 | 1/1993 | Winkle, Sr. et al. . | |

FOREIGN PATENT DOCUMENTS

| | | |
|---|---|---|
| 2013325 | 4/1970 | France . |
| 2947801 | 6/1980 | Germany . |
| 1276019 | of 1972 | United Kingdom . |

OTHER PUBLICATIONS

"Concentration," vol. 1, 1970, Delbert W. Shobe of RTE Corp., 1990 E.North St., Waukesha, Wisconsin, pp. 1–6.

"Concentration," vol. 1, 1973, Robert L. Grunert, RTE Corp., 1900 E.North St., Waukesha, Wisconsin, pp. 1–10.

"Power of Choice," catalog of Cooper Industries, Inc., Pittsburgh, PA, 1991.

"Comparison of Thru–Fault Capabilities of Power Transformer Designs," Roy L. Lane, Hevi–Duti, Goldsboro, NC.

*Primary Examiner*—Carl E. Hall

*Attorney, Agent, or Firm*—St. Onge Steward Johnston & Reens

[57] ABSTRACT

A stock material for winding into a magnet coil includes a running length of conductive aluminum metal having a cross section that has first and second long sides and two short sides. The long sides and short sides meet at corners which are substantially free of jagged edges and sharp corners. An insulating epoxy polymer coating uniformly about 0.001 inches (25 microns) thick covers the first long side and the short sides, with the second long side being substantially free of the insulating coating. A heat-activatable adhesive is arrayed non-continuously on one of the long sides.

9 Claims, 2 Drawing Sheets

METHOD OF MAKING STRIP CONDUCTOR FOR TRANSFORMERS

This application is a continuation of U.S. patent application entitled, "Strip Conductor for Transformers", filed May 14, 1992 and accorded U.S. Ser. No. 07/883,199, now abandoned.

BACKGROUND OF THE INVENTION

The present invention relates to improved strip conductors for winding into coils and the coils made thereby. The coils may be used in transformers or other electrical gear. For the sake of simplicity, the invention will be described herein with reference to winding transformers, but it is to be understood that the invention has a scope wide enough to contemplate coils having various uses.

Transformer winding has been carried out for a great many years. In a transformer, typically two coils are formed and configured so that, when an alternating electric current is conducted through one, a magnetic field is set up which passes through the other, thereby inducing a current in the other coil. Depending upon the numbers of windings involved, the transformer may step up or step down the voltage of the primary coil to the voltage of the secondary coil. Transformers are widely used in electrical power distribution systems to increase their efficiency. As such, they handle high voltages and/or high currents. In order to handle the high currents involved, it has been found that providing the conductor to be wound into the coil in a sheet form is quite advantageous.

The conventional process for winding conductor sheets into a transformer is disclosed in a publication entitled "Concentration", Vol. 1, 1970 by Delbert W. Shobe of RTE Corp., 1900 E. North St., Waukesha, Wis. The transformers are wound from elongated sheets of bare aluminum (or in some cases copper) with interleaved layers of an insulating paper. The paper provides electrical insulation between layers (called "turns") of the wound conductor. An adhesive epoxy is applied to the paper in a diamond pattern before it is wound into the transformer. The completely wound transformer is heated to a high temperature to volatilize any liquids and, at the same time, the epoxy adhesive on the paper binds the conductor turns and paper turns together into a solid unit. After the conductor cools, it is loaded into a casing which is then filled with an insulating transformer oil, which penetrates the paper and the interstices between the diamond pattern of the epoxy adhesive. Connections to the two ends of the coil are typically made at the appropriate time in the processing by cold welding input and output terminations.

This general technique has been used for 20 or more years with adequate success. However, the volumes taken up by the transformer, including the paper, oil and adhesive, can become excessive, particularly when a great many turns are required in the fabrication of a transformer. The paper is typically 5 mils thick, so that 1000 turns would add considerably to the size and bulk of the transformer. The large size causes attendant large costs including a larger housing for the transformer, more oil required, greater shipping costs, and greater difficulties in installing the transformer.

Accordingly, there is a need in the art for a means and method to reduce the size and weight of the wound transformers.

SUMMARY OF THE INVENTION

The present invention fulfills this need in the art by providing a stock material for winding into a magnet coil. A running length of conductive metal has a cross section having first and second long sides and two short sides. An insulating coating covers the first long side and the two short sides, with the second long side being substantially free of the insulating coating.

Typically, the long sides are greater than 30 times longer than the short sides. The long and short sides meet at corners and the corners are preferably substantially free of jagged edges and sharpness.

In a preferred embodiment the first side has a heat-activatable adhesive on its insulating coating. Alternatively, the second side has a heat-activatable adhesive on it. Typically the heat-activatable adhesive is non-continuously arrayed on the selected side. A preferred insulating coating is epoxy. In a most preferred embodiment the coating is an epoxy polymer, and the preferred conductive metal is aluminum. Desirably, the coating is about 0.001 inches (25 microns) thick. Preferably, the insulating coating is uniformly thick on the long side to which it is applied. In a possible variant the coating is acrylic.

In some instances it is desirable for the conductive metal to be thinner adjacent the sides than in the middle.

The invention also provides a method of making a magnet coil. The method includes the steps of providing a running length of conductive metal having first and second long sides and two short sides and an insulating coating on the first long side and the two short sides. The second long side is substantially free of the insulating coating, and one of the first and second sides has a heat-activatable adhesive on it The running length of conductive metal is wound about an axis substantially parallel with the long sides without interleaving other material so that layers of the running length are built up into a coil with the coating on the first side of one layer lying juxtaposed the second side of an adjacent layer. Then, the wound coil is heated to a temperature to activate the adhesive to block the coil. If the adhesive does not continuously cover the long side to which it is applied, the method may proceed with the immersion of the coil in an insulating fluid such as transformer oil to permit the oil to penetrate to interstitial voids in the adhesive between layers. If the adhesive is a B-stage epoxy, the heating step may include heating the wound coil to cross-link the epoxy. In a preferred embodiment the method includes cold welding a termination strip to the second side of the conductor.

The invention further provides a method of making a stock material for winding into a magnet coil. This includes providing a running length of conductive metal having a cross section having first and second long sides and two short sides, and cleaning the running length to remove oils and oxides of the metal. The cleaning step may be omitted in some cases—especially if the strip has already been cleaned such as in a conventional annealing process. Next, an insulating coating is applied on the first long side and the two short sides, with the second long side being substantially free of the insulating coating.

Typically, the long and short sides of the conductive metal meet at corners and the method includes the step of rounding the corners of the conductive metal to make them substantially free of jagged edges and sharpness before applying the insulating coating.

Preferably, the method includes applying a heat-activatable adhesive to one of the long sides, typically in a non-continuous array.

In a preferred embodiment the applying step includes applying a powder coating and fusing the applied powder. In a preferred embodiment this includes applying an epoxy powder coating and fusing and cross-linking the applied epoxy powder. Desirably the coating is applied to be about 0.001 inches (25 microns) thick. Preferably, the coating is applied uniformly thick on the first side. In another embodiment the applying step takes the form of applying an acrylic coating and cross-linking the acrylic with ultraviolet light.

The method may include the preliminary step of providing the conductive metal with a tapered edges.

In another aspect the invention provides a magnet coil made up of an elongated conductive metal having a cross section having first and second long sides and two short sides and wound into a coil about an axis substantially parallel to the long sides so that the first and second long sides generally face one another. An insulating coating adheres directly to the metal on the first long side and the two short sides. An adhesive layer and, perhaps, insulating transformer fluid is interposed between the second long side and the insulating coating, the second long side otherwise being substantially free of direct contact with the insulating coating adhered to the first long side as faced by the second long side. No paper separates the facing long sides. Preferably, a termination strip is cold welded to the second side. The attributes of the winding are those accruing from the use of the stock material described above.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
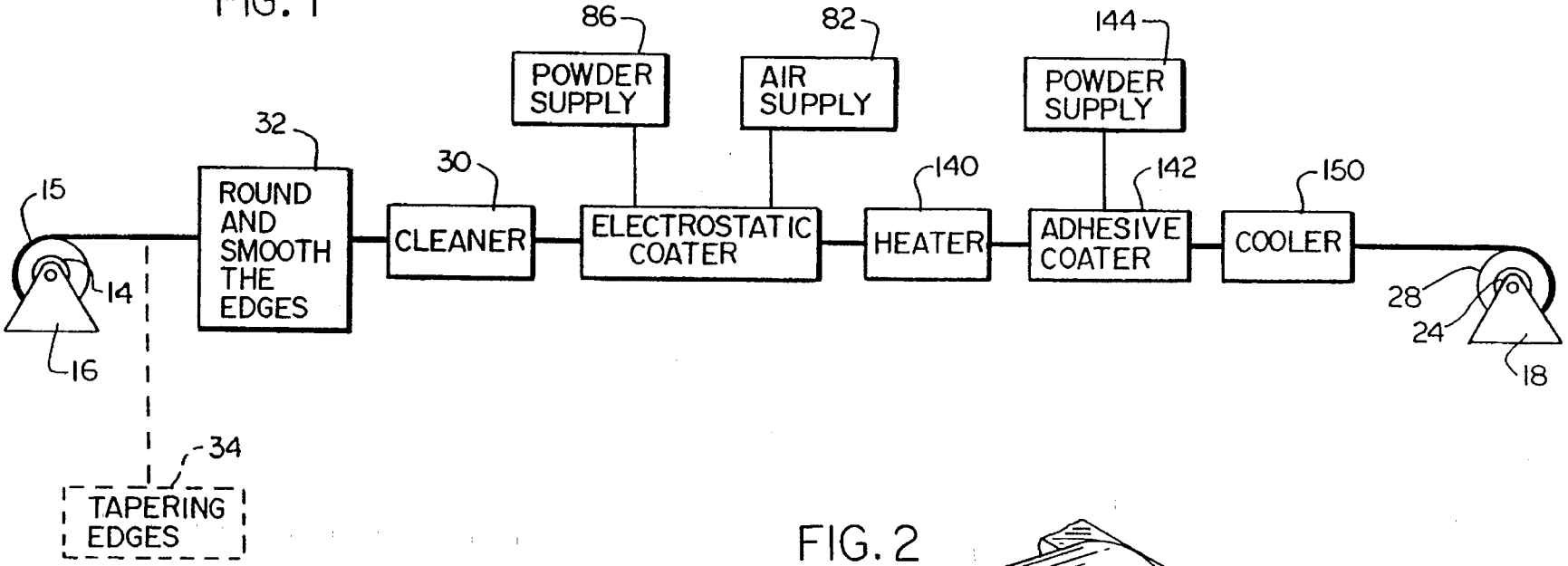
FIG. 1 is a schematic view of the process of forming stock material according to the invention.

FIG. 1 illustrates the various steps involved in fabricating a stock material according to a preferred embodiment. A stock material for winding into a transformer can be made using this process. A conventional aluminum strip conductor coil 15 paying off of a spool 14 mounted on A-frame support 16 is provided. The preferred conductor material is aluminum, although copper may also be suitable. Other conductive metals may be also be substituted. The conductor is in strip form—that is, having a width considerably greater than the thickness of the material, quite unlike a wire or a rectangular configuration conductor. Typical thicknesses of the conductor sheet may range from 1 mil (25 microns) to 100 mils (2500 microns), with widths ranging from 3 to 30 inches (7 to 78 cm). For transformer applications lower ranges of thickness will typically be 7 mils (175 microns). The conductor 15 is commonly formed from slitting wider widths of sheet material. Thus, the edges of the material can often have burrs and sharp edges, which are undesirable in the fabrication of a transformer. A high voltage will be attracted to a sharp point, possibly leading to arcing, or perforation of other components. Accordingly, the conductor 15 is preferably fed through a rounding and smoothing operation 32. The preferred apparatus for performing the rounding and smoothing is disclosed in U.S. Pat. Nos. 3,479,852 to Conrad et al.; 3,601,837 to Conrad et al.; and 3,602,022 to Conrad et al., the disclosures of which are incorporated herein by reference.

Figure 4:
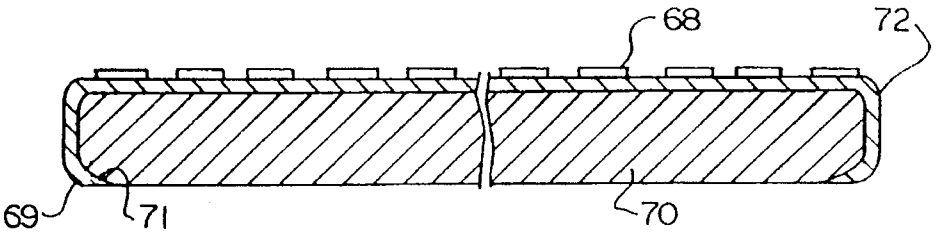
FIG. 4 is a sectional view of an embodiment of the stock material of the invention.

If desired, the rounding and smoothing step may be preceded by an edge tapering step 34, in which the edges are worked to make them slightly thinner than the main body of the conductor width as seen on the left side of FIG. 4. This will permit some insulation to cover the backside at the tapered edge of the conductor and thereby add to the insulation of the edge. This is not, however, necessary.

When the conductor 15 has had its edges rounded and smoothed, it is passed through a cleaning bath 30 of conventional design. The cleaning bath 30 should be such as to remove any residual oils and oxide. The cleaning bath may be alkaline or acid, ionic or non-ionic, depending upon the types of materials to be removed from the conductor. As part of the cleaning step, the conductor is dried, again in conventional fashion. The objective is to exit the cleaning step with clean, bare metal. The conductor then passes into an electrostatic coater 80 of conventional design. The conductor rides on a mesh belt which connects the conductor with a high voltage power supply 84. In the coater 80, the charged conductor passes under a spray gun fed by power supply 86 and an air supply 82 to spray a particulate epoxy coating uniformly over the top flat side of the conductor and the two edges, but not the bottom side. In a preferred embodiment the coater has multiple spray guns and is wide enough to coat several parallel conductors 15.

The powder supply 86 is preferably an epoxy provided in fine enough particles to build up a uniform 2 mil (50 microns) thickness of the powder on the conductor.

A preferred polymer powder is the EVLAST 2000 Series Tan Epoxy Powder Coating X21886-081 available from Evtech of Charlotte, N.C. This material has an average particle size of 33 microns ±3 microns so that it gives a good edge coverage when baked for 10 minutes at 400° F. The spray may be applied through spray guns as directed by the powder manufacturer.

Other epoxy coatings known for use with electrical conductors may also be substituted such as those disclosed in U.S. Pat. Nos. 4,526,804 to Escallon; 4,581,293 to Saunders; 4,085,159 to Marsiat; and 3,647,726 to Ulmer. In addition, the epoxy material disclosed for use in connection with U.S. Pat. No. 4,051,809 to Zicker et al. may also be suitable.

The essential characteristics of the coating is that it be thin, yet uniform over the one flat side and the two edges, with negligible amount of the insulator appearing on the bottom side of the conductor. A preferred thickness is 1 mil (25 to 50 microns).

After application of the powder and the electrostatic coater 80, the conductor passes into a heater 140 which fuses the powder so that it stays in position on the conductor. The heater 140 may also be hot enough and the residence time may be sufficiently long to cross-link the epoxy in the heater 140, but preferably this is done at a later stage of the coil assembly.

From the heater, the still-hot conductor passes to an adhesive coater 142 which applies a heat-activatable adhesive powder from a powder supply 144 to the conductor. The adhesive may be applied to the bare metal side of the conductor, such as through an upwardly flowing adhesive powder supply contacting the bare metal from underneath of a perforated conveyor. The perforated conveyor permits the adhesive to contact the metal in a pattern, such as a diamond pattern. Alternatively, the adhesive powder may be applied to the fused insulating powder on the top side of the conductor, again in a pattern according to a masking arrangement.

Furthermore, the adhesive can be applied in a random coating, dispensing with the pattern effect altogether, if desired. The conductor still has enough heat from the heater 140 to cause the adhesive to fuse to the conductor, but not enough to activate its heat-activating characteristic. The preferred adhesive is a polyvinyl butyral resin powder available commercially as Butvar B-98 from Evtech.

After applying the adhesive, the conductor passes into a cooler 150 to lower the temperature of the conductor to the point where the adhesive and the insulator not tacky, so that upon rewinding the coated conductor 28 on a spool 24 mounted on an A-frame support 18, the conductor does stick to itself. Thus is formed a coil of the stock material which can be shipped to a transformer manufacturer for winding into a transformer.

Figure 2:
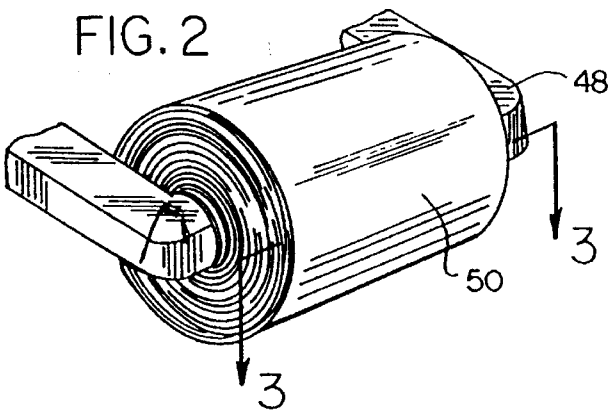
FIG. 2 is a perspective view of a transformer winding according to an embodiment of the invention.
Figure 3:
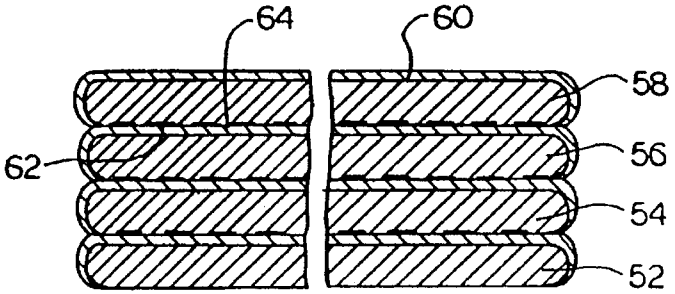
FIG. 3 is a sectional view of the embodiment of FIG. 2 taken along lines 3—3 looking in the direction of the arrows.

An example of a transformer winding is seen in FIG. 2 in which the winding 50 on a core 48 is provided. Of course, many other configurations of windings can be substituted. FIG. 3, taken as a section on the lines 3—3 of FIG. 2, shows the winding which also serves to insulate without the need for the interleaved paper layers. FIG. 3 shows four turns 52,54,56,58 of the conductor layered upon one another. Each turn has its top and two sides covered with the insulator 60. As can be appreciated, the top side of the conductor has the insulator on it in a uniform thickness so that, as the turns accumulate, the outer periphery of the coil is continuous and voids are not formed between one layer and the other. Between each turn, the patterns of adhesive 62,64 are provided which, when heat-activated, will melt and flow to bind the turns together. If adhesive is applied in a pattern, interstices between the patterns 62,64 may be formed to receive and distribute an insulating oil. Alternatively, the adhesive may be applied uniformly or may flow when heated so as to become uniform, so that there are no spaces to make a path for the oil.

FIG. 4 illustrates the embodiment of the stock material in which the conductor 70 is provided with a coating 72 of the insulator and the patterned adhesive 68 is applied directly to the insulator 72. At the left-hand side of FIG. 4 is also illustrated another variant in which the conductor 70 has been tapered at 71, so that the insulating coating continues underneath of the conductor somewhat as is shown at 69, to provide additional insulating characteristics at the edge of the conductor. As can be seen in FIG. 4, the rounded corners of the conductor 70 permit a continuous and smooth buildup of the insulator 72, without thin spots which might be caused by burrs or projections from irregularly cut metal sheet. The use of electrostatic powder deposition as the means of applying the epoxy is highly desirable in order to assure the formation of uniform corners, such as those shown in FIGS. 4 and 5.

Figure 5:
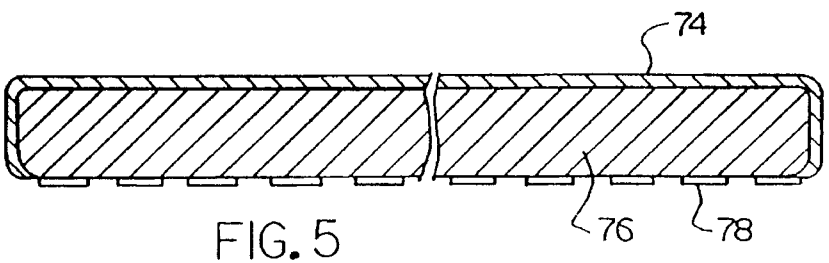
FIG. 5 is a sectional view of an alternate embodiment of the stock material of the invention.

FIG. 5 shows an alternate embodiment in which the conductive material 76 has the insulator 74 on one flat side at the two ends, with the patterned spots of adhesive 78 on the other flat side.

Figure 6:
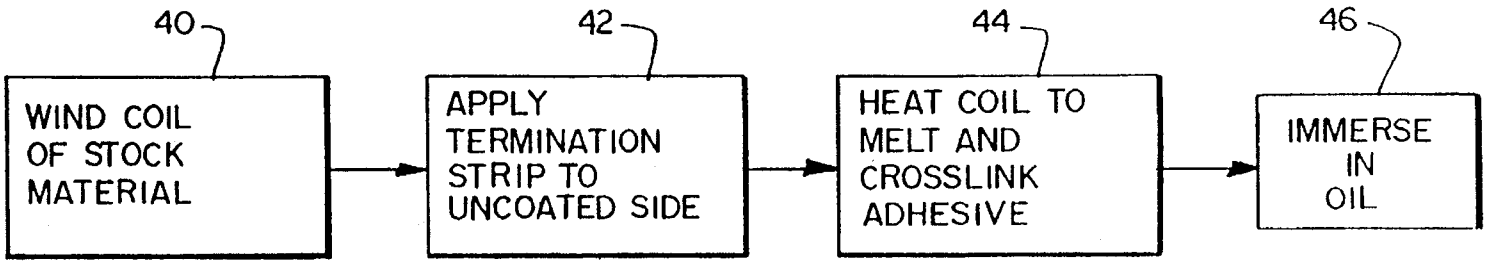
FIG. 6 is a schematic diagram of the process of making a winding according to the invention.

Turning now to FIG. 6, the fabrication of the coil from the stock material will be discussed. First, the coil stock material 28 is wound in conventional fashion to form a transformer coil, with the exception that only the stock material is wound, not any interleaving paper. In winding the transformer, the coating side of the stock material can be placed on either the inside or the outside of each turn, according to the overall transformer design, although outside placement is probably preferred to provide insulation over the outside of the completely wound transformer. As will be appreciated, whether the coating will be placed in compression or tension (which would be affected by which way the coil is turned) may effect the choice of insulating polymers used. A termination strip may be cold-welded to the uncoated side of the stock material in conventional fashion. It should be appreciated that leaving one side of the conductor uncoated makes this step simple, since epoxy need not be scraped off of the conductor.

Then, the coil is heated in a conventional fashion at 44, accomplishing several objectives. First, any volatile materials left on the metal or which may be adhered to the insulation are driven off. Also, the adhesive applied to the conductor is melted and cross-linked to cause it to bind the coil into a solid unit. The insulated coating also preferably cross-links during this step. When the coil cools, the cross-linked and fused polymers solidify the coil into a block so that magnetic forces to be encountered during usage do not cause movement of coil components.

Then, as is conventional, the coil may be immersed in oil at step 46. This latter step is not critical, in that the stock material can be used to make up transformers known as dry type transformers, which are not immersed in oil.

The invention provides considerable advantages of reduction of size of the resulting transformer. Typically, the insulating coating can be applied using the invention will be from about 1–2 mils (25–50 microns) whereas the paper used conventionally is 5 mils (125 microns) thick, plus additional spacing for the adhesive and the oil which impregnated conventional transformers. By reducing the thickness of each turn, substantial size reductions for the overall winding can be obtained without reducing the number of windings. This is known as a increase in the space factor, a ratio of the actual conductive area of a cross-section of the winding versus the overall cross-sectional area. By reducing the volume taken up by insulation, more efficient winding can be obtained.

It may also be that the decrease in size will enable further design changes as a result of more intense magnetic fields being generated by the more compact windings.

Further expense productions can be appreciated from smaller uses of oil between the windings, or no oil between the windings in the case of uniformly applied adhesive layers. The size of the container holding the transformer will be reduced by virtue of the invention. Thus the reduction of all of these components will reduce the overall weight of the transformer, reducing the cost to ship it and reducing complexities involved in installing the transformer.

Finally, additional savings are realized by eliminating the step in winding the transformer of inserting the interleaving paper layer.

While it is preferred that the backside of the conductor of the stock material be free of the insulator, if a few particles of the powder are adhered to the backside, no significant problems arise. Thus, the process is somewhat forgiving if this respect.

An additional particularly contemplated application of the invention is in the fabrication of alternator coils, where the conductor thickness will likely be 1 mil (25 microns).

It is well known that transformers generate heat, and the oil in prior art transformers has been used as a heat conductor to dissipate the heat generated in the windings. It is expected that the more compact windings of the present invention, with their higher proportion of electrical conductor to insulator will increase the conduction of heat laterally from the transformer. Potentially, less oil ducting will be needed than with prior art designs.

Although powder coating is particularly preferred, the application of liquid polymers which are then cross-linked, such acrylic, may also be useful.

The successful coating of the edges of the conducted strip is of prime importance in the present invention. The actual turn-to-turn voltage is often very small, on the order of ½ volt, so that the demands of insulating one turn from its adjacent turn are not great. However, the edges are exposed to transients including those induced by lightning strikes and the like, so that adequate and thorough edge coverage is critical in the formation of a successful product.

Those of ordinary skill in the art will, on the basis of the foregoing, be able to make various modifications to the specific embodiments described herein and such variations are deemed to be within the scope of the invention.

What is claimed is:

1. A method of making a magnet coil comprising the steps of:

providing a running length of conductive metal having first and second long sides and two slit edges, the said sides edges meeting at sharp corners;

rounding on said running length said sharp corners that are formed between said first side and said edges to make them substantially free of sharpness;

applying an insulating polymer coating on the first long side, said rounded corners and the two edges, with the second long side being substantially free of the insulating coating;

applying on one of the first and second sides a heat-activatable adhesive;

winding the coated conductive metal about an axle substantially parallel with the long sides so that layers of the length are built up into a coil with the coating on the first side of one layer lying juxtaposed the second side of an adjacent layer, and so that adjacent layers of conductive metal are electrically insulated by said insulating coating, and heating the wound coil to a temperature to activate the adhesive to block the coil.

2. A method as claimed in claim 1 and in which the adhesive does not continuously cover the long side to which it is applied, further comprising immersing the coil in oil to permit the oil to penetrate to interstitial voids in the adhesive between layers.

3. A method as claimed in claim 1 wherein the adhesive is a B-stage epoxy and the heating step includes heating the wound coil to cross-link the epoxy.

4. A method as claimed in claim 1 including cold welding a termination strip to the second side of the conductor.

5. A method for making a magnet coil comprising the steps of:

providing a running length of conductive metal having first and second long sides and two slit edges, the sides and edges meeting at sharp corners;

rounding on said running length said sharp corners that are formed between said first side and said edges to make them substantially free of sharpness;

applying an insulating polymer coating on the first long side; said rounded corners, and the two edges, with the second long side being substantially free of the insulating coating;

applying on one of the first and second sides a B-stage epoxy adhesive which does not continuously cover the long side to which it is applied;

winding the coated conductive metal about an axis substantially parallel with the long sides without interleaving other material so that layers of the running length are built up into a coil with the coating on the first side of one layer lying juxtaposed the second side of an adjacent layer, and so that adjacent layers of conductive metal are electrically insulated by said insulating coating;

cold welding a termination strip to the second side of the conductor, heating the wound coil to a temperature to cross-link the epoxy adhesive to block the coil; and immersing the coil in insulating fluid to permit the insulating fluid to penetrate to interstitial voids in the adhesive between layers.

6. A method of according to claim 1 wherein the steps of applying insulating coating, applying adhesive and winding the coated metal are performed continuously on a running length of conductive metal.

7. A method of according to claim 1 wherein said step of providing a running length of conductive metal comprises slitting a wide width of sheet material formed of conductive metal and providing said running length of conducted metal and wherein said slitting and rounding steps are performed continuously on said running length of metal.

8. A method according to claim 1, wherein the steps of rounding, applying insulating coating, applying adhesive and winding the coating metal are performed continuously on a running length of conductive metal.

9. A method of making a magnetic coil from a length of conductive metal having first and second long sides and two slit edges, the sides and edges meeting at sharp corners, the method comprising the steps of:

a) rounding on said length of conductive metal said sharp corners that are formed between said first side and said edges to make them substantially free of sharpness;

b) in a continuous and serial fashion, applying to said length of conductive metal the following steps:

i) applying an insulating coating on the first long side, said rounded corners and the two edges, with the second long side being substantially free of the insulating coating;

ii) applying an adhesive on an least one of said sides;

iii) winding the coated metal about an axis substantially parallel with the long sides so that layers of the length are built into a coil with the coating on the first side of one layer lying juxtaposed the second side of adjacent layer, said rounded corners permitting a continuous and smooth buildup of the insulating coating in the absence of a sharp corner thereby substantially avoiding high voltage arcing and perforation of adjacent insulating coating; and c) activating the adhesive to block the coil.

* * * * *